US010563389B2

(12) United States Patent
Casarez

(10) Patent No.: US 10,563,389 B2
(45) Date of Patent: Feb. 18, 2020

(54) ODOR REMOVAL SYSTEMS FOR TOILETS

(71) Applicant: Jose A. Casarez, Omaha, NE (US)

(72) Inventor: Jose A. Casarez, Omaha, NE (US)

( * ) Notice: Subject to any disclaimer, the term of this patent is extended or adjusted under 35 U.S.C. 154(b) by 0 days.

(21) Appl. No.: 15/977,510

(22) Filed: May 11, 2018

(65) Prior Publication Data

US 2019/0345706 A1 Nov. 14, 2019

(51) Int. Cl.
*E03D 9/05* (2006.01)
*E03D 11/13* (2006.01)

(52) U.S. Cl.
CPC ..... *E03D 9/05* (2013.01); *E03D 11/13* (2013.01)

(58) Field of Classification Search
CPC ..... E03D 9/05
USPC ..... 4/213
See application file for complete search history.

(56) References Cited

U.S. PATENT DOCUMENTS 4,876,748 A 10/1989 Chun
6,233,750 B1 * 5/2001 Donald ..... E03D 9/007 4/213
6,629,319 B2 10/2003 Simpson
2002/0002735 A1 1/2002 Moon
2008/0000017 A1 * 1/2008 Littrell ..... E03D 9/052 4/213
2008/0034482 A1 * 2/2008 Lehman ..... E03D 9/05 4/217

* cited by examiner

*Primary Examiner* — Christine J Skubinna

(57) ABSTRACT

A system for removing malodors from a toilet is described herein. The system has a seat base that is placed on top of a toilet bowl, and an air purifying device fluidly coupled to the seat base. An air drawing component of the air purifying device suctions the malodors, which flow through a channel into an air intake of the seat base, exits through an air outtake, and is directed into an air filtration component. The air filtration component filters the malodors to produce filtered air that is released into the surrounding environment.

8 Claims, 6 Drawing Sheets

ODOR REMOVAL SYSTEMS FOR TOILETS

FIELD OF THE INVENTION

The present invention relates to odor removal systems, namely, for removing odor from toilets.

BACKGROUND OF THE INVENTION

Toilets are sanitation receptacles located in bathroom facilities for collecting and disposing of wastes, namely urine and feces. Toilets may comprise a toilet bowl having a toilet seat, an optional cover, and a flushing mechanism. These receptacles are typically configured for sitting positions. While a person can flush a toilet to dispose of waste into sewage lines and septic systems, there may remain an unpleasant odor that lingers in the surrounding environment, particularly when one defecates. This situation can be a source of embarrassment to the person. Current methods to remove this odor include the use of air fresheners and venting systems. However, air fresheners may only slightly mask the odor, and vents are typically located in the ceiling of the bathroom; thus, the odor can still linger.

Another method to mitigate this problem is to remove the odor directly from the toilet before it can permeate into the surrounding environment. For example, US20020002735 of Moon discloses a stench eliminating apparatus having a plurality of suction inlets formed underneath a seat plate for sucking in air within the toilet bowl, a suction passage formed along a margin of the seat plate for collecting the air sucked in through the plurality of suction inlets, a blower mounted in communication with the suction passage, and a drain passage communicating with a discharge outlet of the blower. However, a disadvantage of Moon is that the discharge outlet is connected downstream of a sink p-trap. As known to one of ordinary skill in the art, a P-trap creates a water seal to block odors from emanating from a septic system. Thus, by placing the discharge outlet after the p-trap, the Moon apparatus creates another avenue for sewage gases to escape through the suction inlets, which would worsen the stench in the surrounding environment.

Another example is provided in U.S. Pat. No. 4,876,748 of Chun, which discloses a toilet bowl venting and deodorizing structure incorporating a housing having an air inlet means at one end, air outlet means at the other end, an air filtering panel means within the housing, and an electric motor including a rotatable output shaft portion and a pair of axial flow impellers mounted on the rotary output shaft within the housing on opposite sides of the air filtering panel means. The inlet opening communicates with an area adjacent the upper rim portion of an associated toilet bowl through the utilization of a flexible conduit and the motor is operably connected to a suitable source of electrical potential through a pressure switch designed to be closed upon downward force being applied to the hinged seat portion of the associated toilet bowl. However, the air inlet means is oriented laterally relative to the upper rim portion such that the inlet openings face sideways. When in operation, debris and fluids may be suctioned into the air inlet means. For instance, toilet paper may be drawn to the air inlet means thus blocking the inlet openings. As such, there is a need for an odor remover that can effectively remove malodor without interfering with toilet usage.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

It is an objective of the present invention to provide for an odor removal system for removing malodors from a toilet, as specified in the independent claims. Embodiments of the invention are given in the dependent claims. Embodiments of the present invention can be freely combined with each other if they are not mutually exclusive.

In some aspects, the odor removal system may comprise a seat base configured to be placed on a back end of a toilet bowl, a toilet seat pivotably connected to the seat base, and an air purifying device fluidly coupled to the seat base. The seat base may comprise a base housing having an air intake disposed on an interior edge of the base housing, and an air outtake disposed on an exterior edge of the base housing and fluidly coupled to the air intake. The toilet seat has a lip disposed on an inner rim of the toilet seat and projecting outwardly from an underside surface of the toilet seat. As such, when the toilet seat is in a closed position, the lip is configured to overlap the air intake of the base housing, thus forming a channel between the lip and air intake so as to allow air flow into the air intake.

In other aspects, the odor removal system may comprise a seat base and an air purifying device fluidly coupled to the seat base. The seat base may comprise a base housing having a flange projecting perpendicularly from an interior edge of the base housing, an air intake disposed on an inner side surface of the flange, and an air outtake disposed on an exterior edge of the base housing and fluidly coupled to the air intake. The seat base is adapted to be placed on a toilet bowl such that a bottom surface of the base housing is contacting a top surface of the toilet bowl and the flange is positioned to hang downwardly from an inner toilet bowl rim of the toilet bowl so that the inner side surface and air intake of the flange faces an interior surface of the toilet bowl. Thus, a channel is formed between the interior surface of the toilet bowl and air intake so as to allow air flow into the air intake.

One of the unique and inventive technical features of the present invention is the channel formed from either the toilet seat lip with the air intake, or the flange with the interior surface of the toilet bowl. Without wishing to limit the invention to any theory or mechanism, it is believed that the technical feature of the present invention advantageously prevents air flow obstruction while also preventing debris from being suctioned into the air intake. None of the presently known prior references or work has the unique inventive technical feature of the present invention.

BRIEF DESCRIPTION OF THE DRAWINGS

The features and advantages of the present invention will become apparent from a consideration of the following detailed description presented in connection with the accompanying drawings in which.

DESCRIPTION OF PREFERRED EMBODIMENTS

Figure 1B:
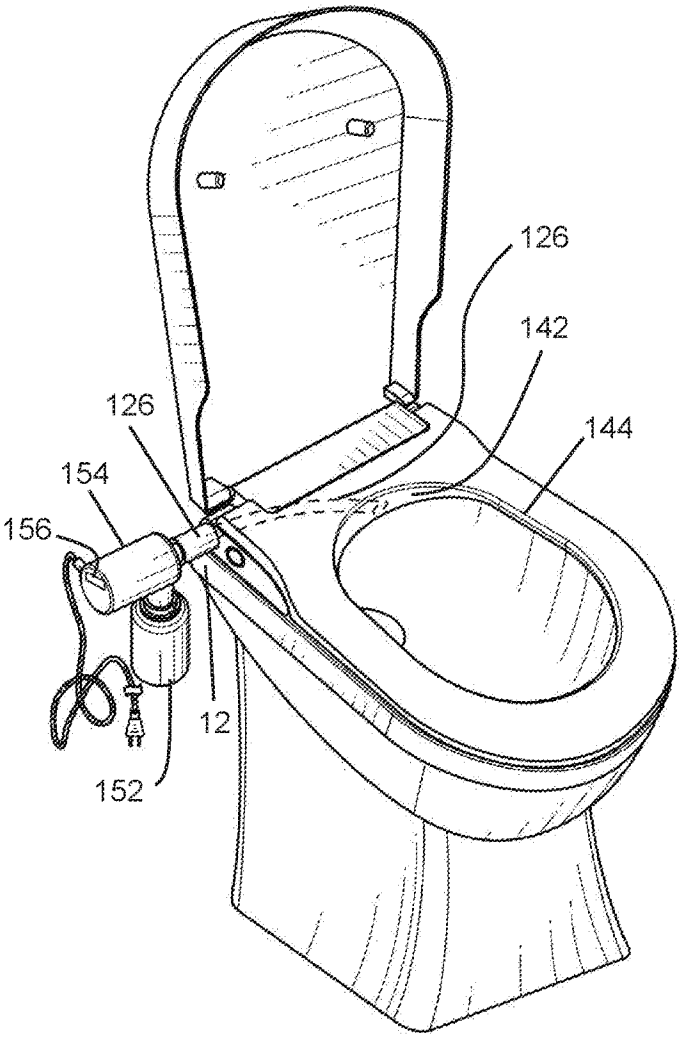
FIG. 1B shows the odor removal system with the toilet seat and lid in a closed configuration.
Figure 1A:
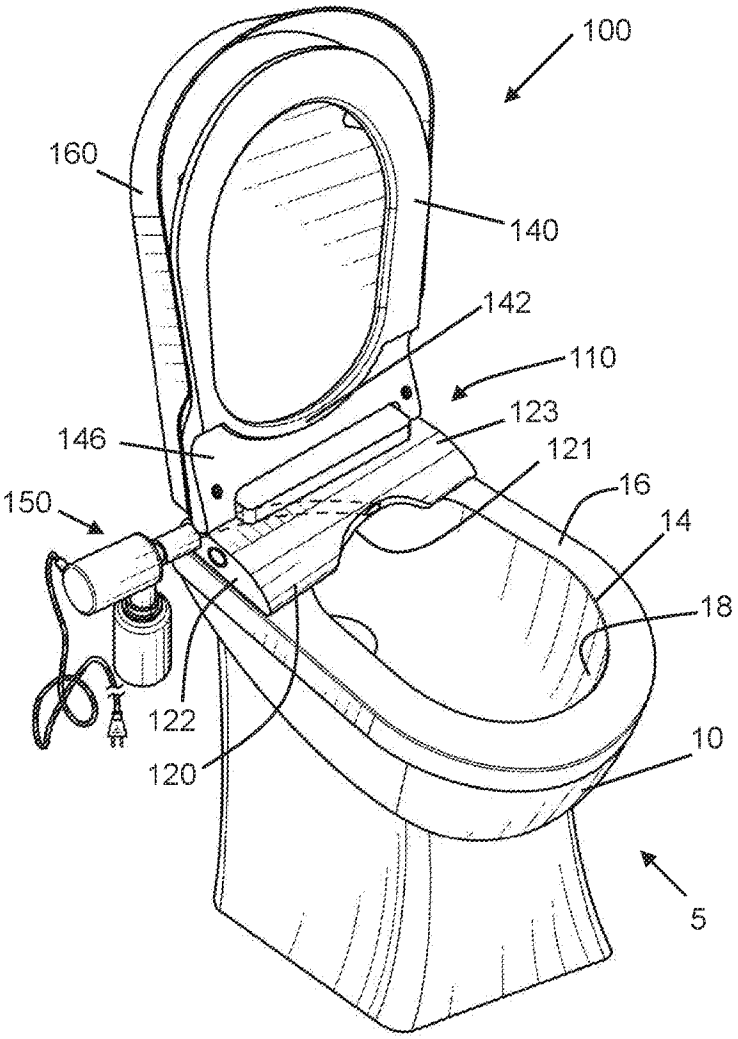
FIG. 1A shows an odor removal system of the present invention with a toilet seat and lid in an open configuration.

Following is a list of elements corresponding to a particular element referred to herein:

5 toilet
10 toilet bowl
12 back end of a toilet bowl
14 inner toilet bowl rim
16 top surface of the toilet bowl
18 interior surface of the toilet bowl
100 odor removal system
110 seat base
120 base housing
121 interior edge of the base housing
122 exterior edge of the base housing
123 top surface of the base housing
124 bottom surface of the base housing
125 hollow interior chamber
126 tubing
127 air intake
128 air outtake
130 toilet seat connector
135 toilet lid connector
140 toilet seat
142 toilet seat lip
144 inner rim of the toilet seat
146 underside surface of the toilet seat
148 channel
150 air purifying device
152 air filtration component
154 air drawing component
156 power switch
158 air vent
160 toilet lid
1120 flange
1121 inner side surface of the flange
1122 terminal edge of the flange Referring now to FIG. 1A-1B, the present invention features an odor removal system (100) for removing malodors from a toilet (5). In some embodiments, the system (100) may comprise a seat base (110) configured to be placed on a back end (12) of a toilet bowl (10), a toilet seat (140) pivotably connected to the seat base (110), and an air purifying device (150) fluidly coupled to the seat base (110).

In one embodiment, the seat base (110) may comprise a base housing (120) having an air intake (127) disposed on an interior edge (121) of the base housing, and an air outtake (128) disposed on an exterior edge (122) of the base housing and fluidly coupled to the air intake (127). In one embodiment, the base housing (120) can have a hollow interior chamber (125). A tubing (126) may be disposed inside the hollow interior chamber and fluidly connects the air intake (127) to the air outtake (128). In one embodiment, the air intake may be centrally disposed on the interior edge of the base housing. In another embodiment, the air outtake may be disposed on a side or back exterior edge of the base housing. In preferred embodiments, the interior edge (121) of the base housing is adapted to be positioned at or adjacent to an inner toilet bowl rim (14) of the toilet bowl. For example, the interior edge (121) may extend about ¼" to about 2" past the inner toilet bowl rim (14). Alternatively, the interior edge (121) may be flushed with the inner toilet bowl rim (14).

Figure 2B:
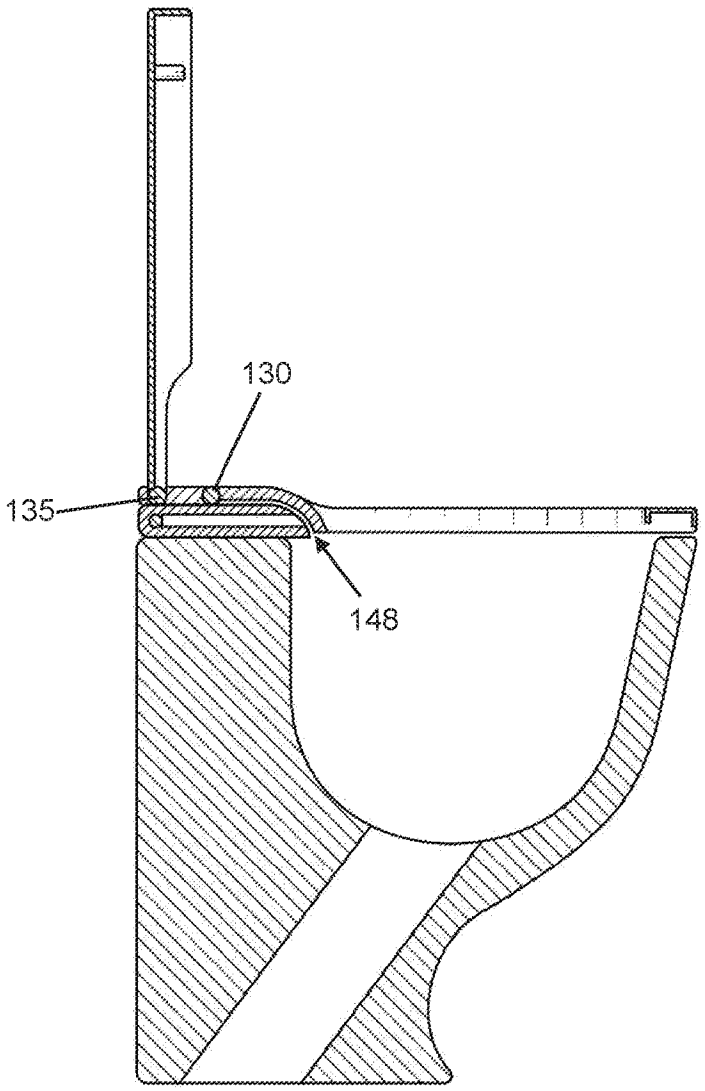
FIG. 2B shows a cross-sectional view of the odor removal system with the toilet seat in the closed configuration.
Figure 2A:
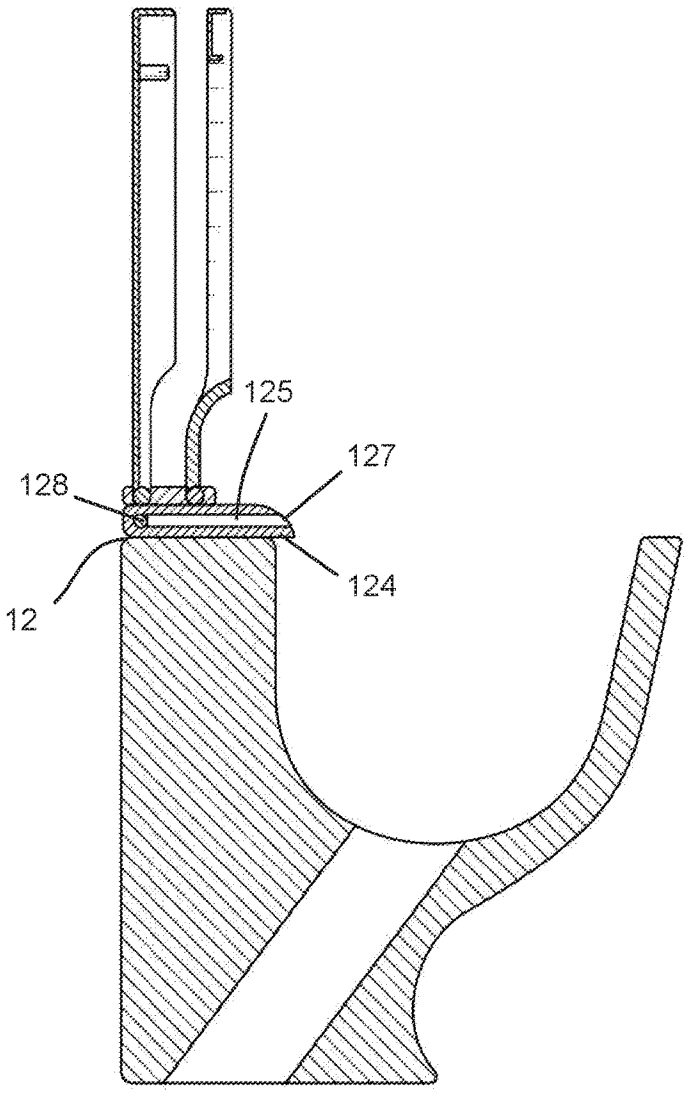
FIG. 2A shows a cross-sectional view of the odor removal system with the toilet seat in the open configuration.

In other embodiments, the seat base (110) may also include a toilet seat connector (130) disposed on a top surface (123) of the base housing. In one embodiments, the toilet seat (140) may be pivotably connected to the base housing (120) via the toilet seat connector (130). Referring to FIGS. 2A-2B, in preferred embodiments, the toilet seat (140) has a lip (142) disposed on an inner rim (144) of the toilet seat and projecting outwardly from an underside surface (146) of the toilet seat. As such, when the toilet seat (140) is in a closed position such that the toilet seat (140) is parallel to the base housing (120), the lip (142) is configured to overlap the air intake (127) of the base housing, thus forming a channel (148) between the lip (142) and air intake (127) so as to allow air flow into the air intake (127). Without wishing to limit the invention to a particular mechanism, the toilet seat lip forming the channel with the air intake can prevent air obstruction while also preventing debris from being suctioned into the air intake.

In some embodiment, the seat base (110) may further include a toilet lid connector (135) disposed adjacent to the toilet seat connector (130). As such, the system may further comprise a toilet lid (160) pivotably connected to the base housing (120) via the toilet lid connector (135). As shown in FIG. 1A, the seat base has a platform disposed on a top surface (123) of the base housing. The toilet lid connector (135) and the toilet seat connector (130) may be disposed on the side edges of the platform. Preferably, the toilet lid connector (135) is closer to the back edge of the platform and the toilet seat connector (130) is closer to the front edge of the platform. Thus, when the system is in a closed configuration, the toilet lid covers and overlaps the toilet seat.

In some embodiments, the air purifying device (150) may be fluidly coupled to the air outtake (128) of the base housing. For instance, a conduit (126) or tubing may fluidly connect the air purifying device (150) to the air outtake (128). In some embodiments, the air purifying device (150) may comprise an air filtration component (152), an air drawing component (154) fluid coupled to the air filtration component (152), and a power switch (156) operatively coupled to the air drawing component (154) for turning the air drawing component (154) on and off. The power switch (156) may be a manual switch, such as a proximity switch or an infrared proximity switch.

In some embodiments, the odor removal system (100) may be use in a method to remove malodors from the toilet (5). To implement the method, the toilet seat is disposed in the closed position and the air drawing component (154) is turned on via the power switch (156). The air drawing component (154) suctions the malodors such that the malodors flow into the channel (148) and the air intake (127), exits through the air outtake (128), and is directed into the air filtration component (152). The air filtration component (152) filters the malodors to produce filtered air that exits the air purifying device (150) via air vents (158). In some embodiments, the method may be implemented before using the toilet, during use, after use, or a combination thereof. After a sufficient period of time has passed to ensure that there are little to no lingering malodors, the air drawing component (154) is then turned off via the power switch.

Figure 3:
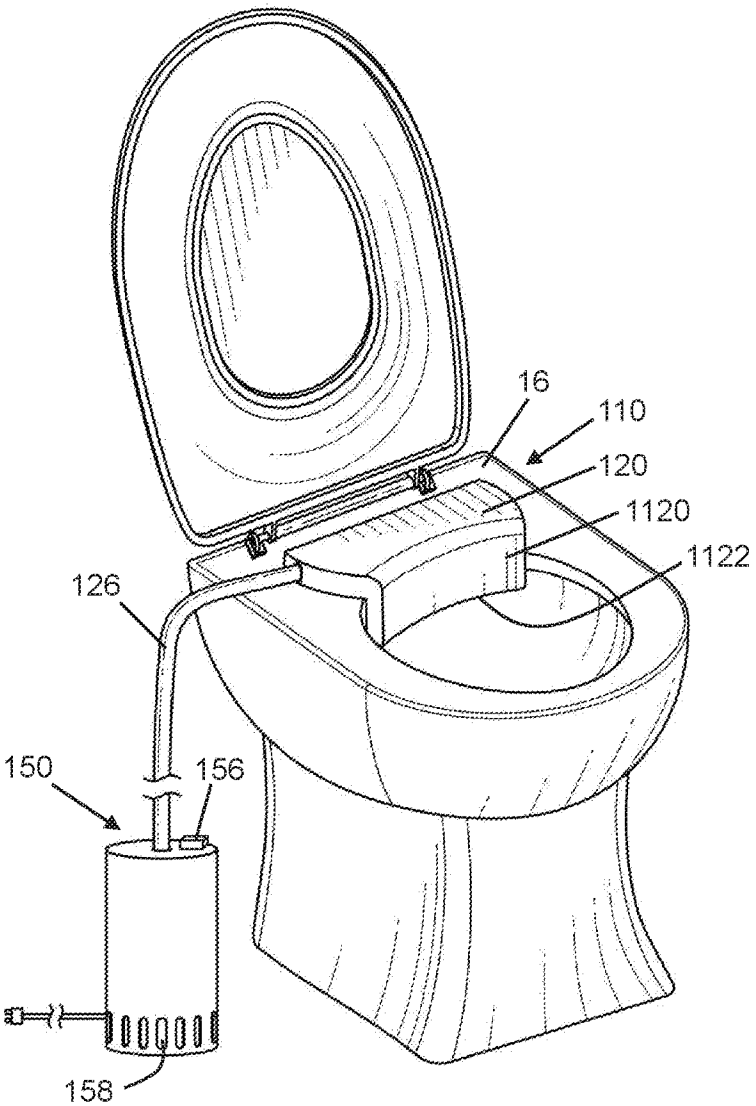
FIG. 3 shows an alternative embodiment of the odor removal system.

Referring now to FIG. 3, according to another embodiment, the odor removal system (100) for removing malodors from a toilet (5) may comprise a seat base (110) and an air purifying device (150). The seat base (110) may comprise a base housing (120) having a flange (1120) projecting perpendicularly from an interior edge (121) of the base housing, an air intake (127) disposed on an inner side surface (1121) of the flange (1120) at or near a terminating edge (1122) of the flange (1120), and an air outtake (128) disposed on an exterior edge (122) of the base housing and fluidly coupled to the air intake (127).

In some embodiments, the air purifying device (150) may be fluidly coupled to the air outtake (128) of the base housing. For example, a conduit (126) or tubing fluidly connects the air purifying device (150) to the air outtake (128) of the base housing. In one embodiment, the air purifying device (150) may comprise an air filtration component (152), an air drawing component (154) fluid coupled to the air filtration component (152), and a power switch (156) operatively coupled to the air drawing component (154) for turning the air drawing component (154) on and off. In one embodiment, the power switch is a manual switch, such as a proximity switch or an infrared proximity switch.

Figure 4:
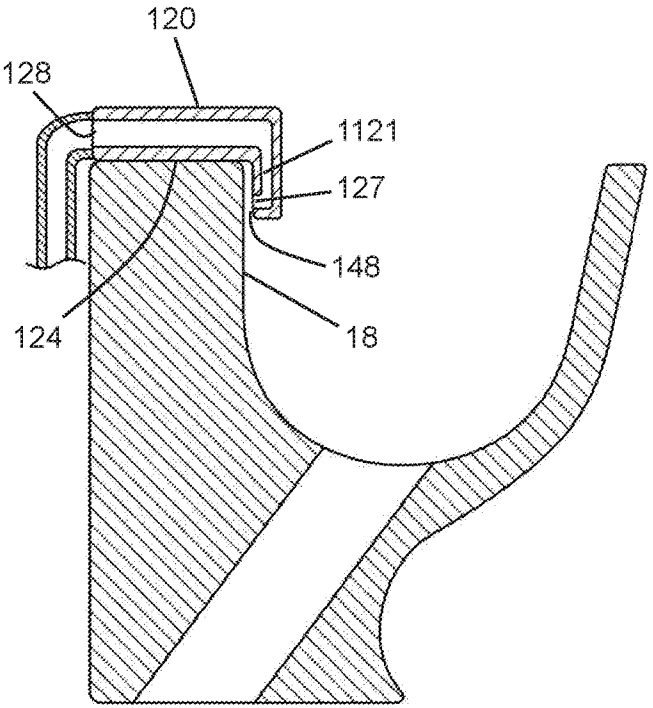
FIG. 4 shows a cross-sectional view of the odor removal system according to FIG. 3

In preferred embodiments, as shown in FIG. 4, the seat base (110) is adapted to be placed on a toilet bowl (10) such that a bottom surface (124) of the base housing is contacting a top surface (16) of the toilet bowl (10). More preferably, the flange (1120) is positioned to hang downwardly from an inner toilet bowl rim (14) of the toilet bowl so that the inner side surface (1121) and air intake (127) of the flange (1120) faces an interior surface (18) of the toilet bowl. Thus, a channel (148) is formed between the interior surface (18) of the toilet bowl and air intake (127) so as to allow air flow into the air intake (127). Without wishing to limit the invention to a particular mechanism, the flange forming the channel with interior surface (18) of the toilet bowl can prevent air obstruction while also preventing debris from being suctioned into the air intake.

In some embodiments, the odor removal system (100) may be use in a method to remove malodors from the toilet (5). To implement the method, the seat base (110) is placed on the toilet bowl (10) such that a bottom surface (124) of the base housing is contacting the top surface (16) of the toilet bowl (10) and the flange (1120) hangs downwardly from the inner toilet bowl rim (14) so that the inner side surface (1121) and air intake (127) of the flange (1120) faces an interior surface (18) of the toilet bowl. The air drawing component (154) is then turned on via the power switch (156) and suctions the malodours. Preferably, the malodors flow through the channel (148) and into the air intake (127), exit through the air outtake (128), and are directed into the air filtration component (152), which filters the malodors to produce filtered air that exits the air purifying device (150) via air vents (158). The method may be implemented before using the toilet, during use, after use, or a combination thereof. After a sufficient period of time has passed to ensure that there are little to no lingering malodors, the air drawing component (154) is then turned off via the power switch.

Figure 5:
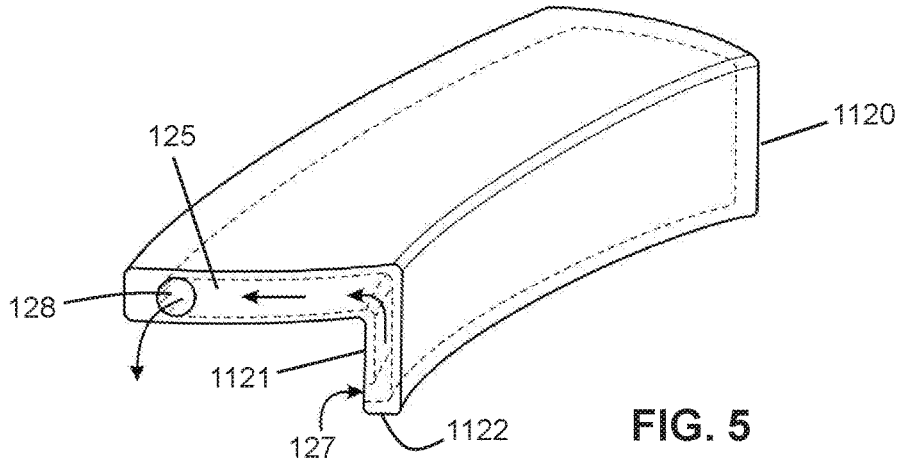
FIG. 5 shows of a seat base of the odor removal system and air flow path.
Figure 6A:
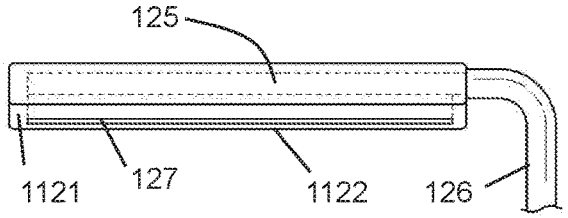
FIG. 6A shows a back view of the seat base having a slat air intake.
Figure 6B:
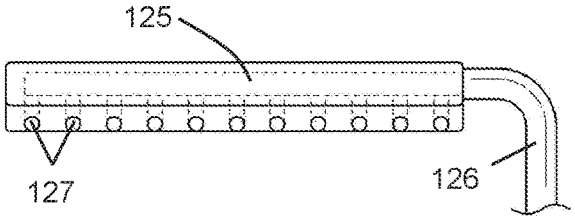
FIG. 6B shows a back view of the seat base having a plurality of intake apertures.
Figure 7:
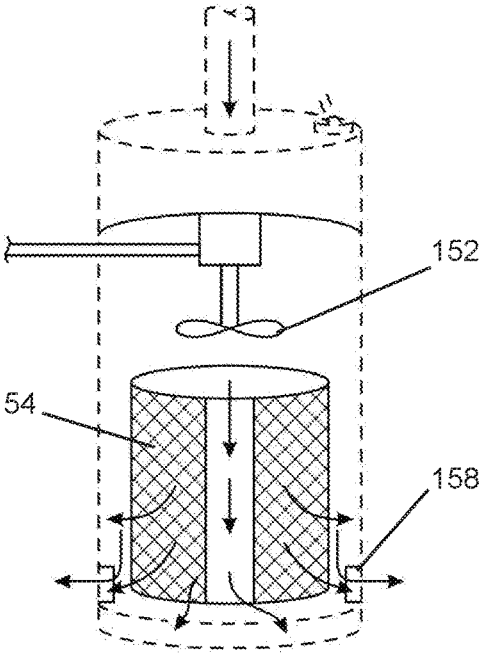
FIG. 7 shows a cross-sectional view of an air purifying device of the odor removal system.

In some embodiments, as shown in FIG. 5, the base housing (120) can have an interior chamber (125) that fluidly connects the air intake (127) to the air outtake (128). Referring to FIG. 6A, in one embodiment, the air intake may be an elongated slot that is parallel to the terminal edge (1122) of the flange (1120). The elongated slot can have a J-shaped interior channel that merges with the interior chamber of the base housing. In some embodiments, the elongated slot may be about 0.5-1 cm wide (top to bottom) and about 10-30 cm long (side to side). Referring to FIG. 6B, in another embodiment, the air intake may comprise a plurality of apertures, each aperture fluidly coupled to its own interior channel disposed within the flange. Each interior channel then merges with the interior chamber of the base housing. In some embodiments, the apertures can have an opening surface area of about 1 $mm^2$-1 $cm^2$, for example, about 25 $mm^2$. In other embodiments, the flange can have a width of about 2-5 cm. Preferably, the flange can have a curvature similar to the curvature of the inner toilet bowl rim.

Figure 10:
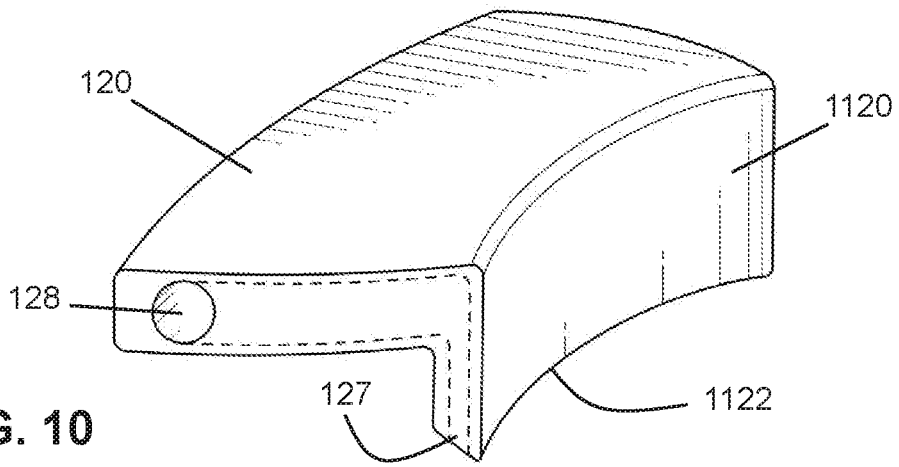
FIG. 10 shows an alternative embodiment of a flange of the seat base.

An alternative embodiment of the flange is shown in FIG. 10. In this embodiment, the terminal end of the flange is angled such that the external side surface of the flange extends past the internal side surface of the flange. The air intake may be disposed on the terminal end of flange and faces downwardly. Without wishing to limit the invention to a particular mechanism, the external side surface of the flange extending past the internal side surface of the flange can prevent preventing debris from being suctioned into the air intake while allowing air flow into the air intake In some embodiments, the air purifying device (150) described herein may be battery-powered or AC/DC powered. In one embodiment, the air filtration component (152) may comprise an activated charcoal filter, a HEPA filter, or an odor absorber air filter or sponge. In another embodiment, the air drawing component (154) may comprise a suction or vacuum air pump. For example, the air drawing component (154) may include a centrifugal fan or blower. In some embodiments, the vacuum pump is similar to that of the pump disclosed in U.S. Pat. No. 6,629,319, the disclosure of which is incorporated in its entirety herein by reference.

Figure 8:
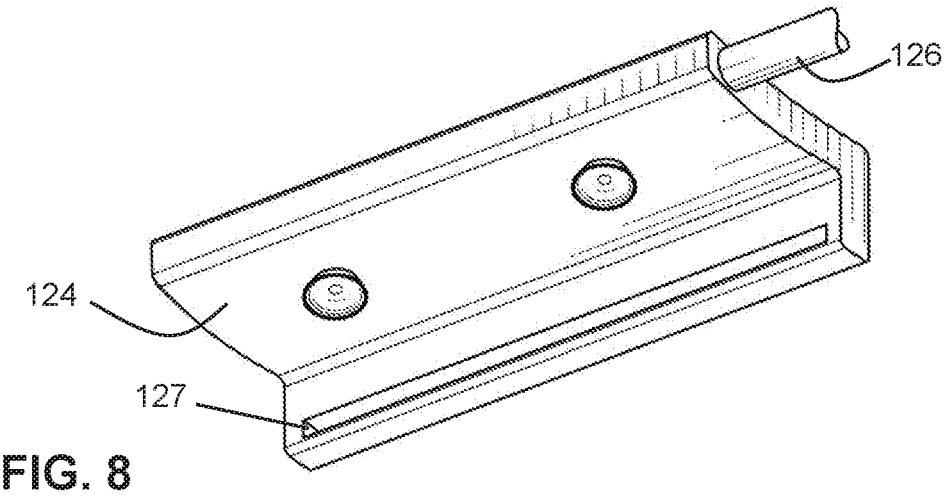
FIG. 8 shows an embodiment of an attachment component of the seat base.
Figure 9:
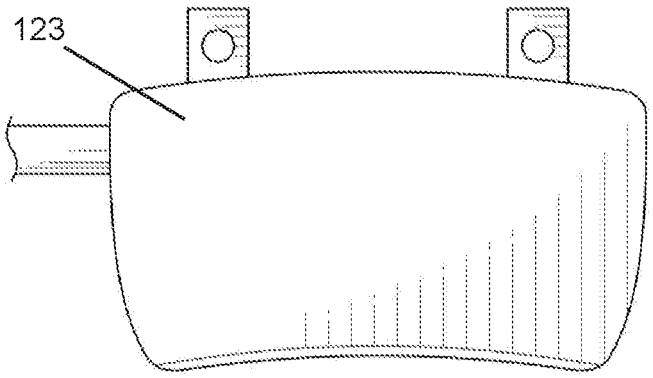
FIG. 9 shows an alternative embodiment of the attachment component.

Referring to FIG. 8, the seat base (110) may be attached to the toilet bowl via suction cups disposed on the bottom surface of the base housing. Alternatively, as shown in FIG. 9, the seat base (110) may be attached to the toilet bowl via seat brackets. In one embodiment, the seat brackets are compatible with existing connectors of the toilet bowl. In another alternative embodiment, the bottom surface of the base housing may include adhesives or non-slip gripping material for attaching the seat base to the toilet bowl.

Figure 11B:
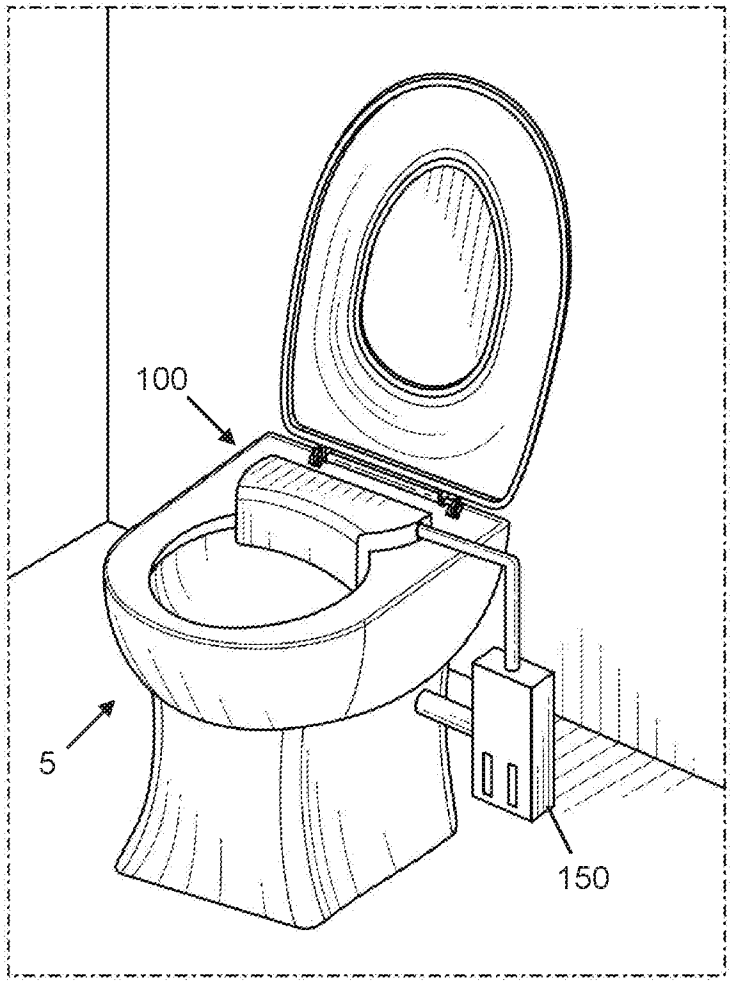
FIG. 11B shows the air purifying device alternatively mounted to the toilet.
Figure 11A:
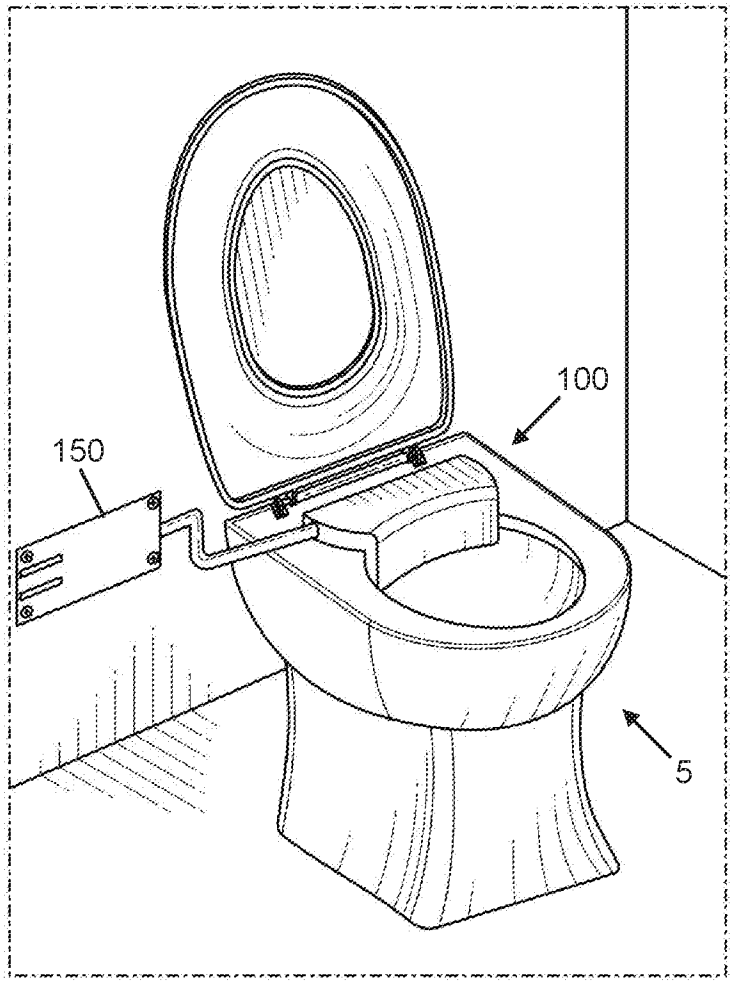
FIG. 11A shows an embodiment of the air purifying device mounted to a wall.

In one embodiment, the air purifying device (150) may be placed on a floor adjacent to the toilet. In another embodiment, as shown in FIG. 11A, the air purifying device (150) may be hung from a wall adjacent to the toilet. In yet another embodiment, as shown in FIG. 11B, the air purifying device (150) may be mounted onto and hung from the toilet bowl.

As used herein, the term "about" refers to plus or minus 10% of the referenced number.

The disclosures of the following U.S. Patents are incorporated in their entirety by reference herein: US20020002735, U.S. Pat. Nos. 6,629,319, and 4,876,748.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An odor removal system (100) for removing malodors from a toilet (5), said system (100) comprising:

a. a seat base (110) comprising a base housing (120) having a flange (1120) projecting perpendicularly from an interior edge (121) of the base housing, an air intake (127) disposed on an inner side surface (1121) of the flange (1120) at or near a terminal edge (1122) of the flange (1120), and an air outtake (128) disposed on an exterior edge (122) of the base housing and fluidly coupled to the air intake (127); and b. an air purifying device (150) fluidly coupled to the air outtake (128) of the base housing, said air purifying device (150) comprising an air filtration component (152), an air drawing component (154) fluid coupled to the air filtration component (152), and a power switch (156) operatively coupled to the air drawing component (154) for turning the air drawing component (154) on and off, wherein the seat base (110) is adapted to be placed on a toilet bowl (10) such that a bottom surface (124) of the base housing is contacting a top surface (16) of the toilet bowl (10) and the flange (1120) hangs from an inner toilet bowl rim (14) of the toilet bowl so that the inner side surface (1121) and air intake (127) of the flange (1120) face horizontally inward towards a side interior surface (18) of the toilet bowl, wherein a channel (148) is formed between the interior surface (18) of the toilet bowl and air intake (127) so as to allow air flow into the air intake (127).

2. The system (100) of claim 1, wherein the power switch (156) is a manual switch.

3. The system (100) of claim 2, wherein the manual switch is a proximity switch or an infrared proximity switch.

4. The system (100) of claim 1, wherein the base housing (120) has an interior chamber (125) that fluidly connects the air intake (127) to the air outtake (128).

5. The system (100) of claim 1, wherein a conduit (126) fluidly connects the air purifying device (150) to the air outtake (128) of the base housing.

6. The system (100) of claim 1, wherein the air filtration component (152) comprises an activated charcoal filter.

7. The system (100) of claim 1, wherein the air drawing component (154) comprises a vacuum pump.

8. The system (100) of claim 1, wherein to remove malodors from the toilet (5), the air drawing component (154) is turned on via the power switch (156), wherein the air drawing component (154) suctions the malodors such that the malodors flow into the channel (148) and the air intake (127), exits through the air outtake (128), and is directed into the air filtration component (152), which filters the malodors to produce filtered air that exits the air purifying device (150) via air vents (158).

* * * * *